US005286051A

United States Patent [19]

Scherübl

[11] Patent Number: 5,286,051

[45] Date of Patent: Feb. 15, 1994

[54] ALPINE SKI WITH A MINIMUM WIDTH AND SPECIFIC WIDTH/LENGTH RATIO

[75] Inventor: Franz Scherübl, Österreich, Austria

[73] Assignee: Atomic Skifabrik Alois Rohrmoser, Wagrain, Austria

[21] Appl. No.: 964,552

[22] Filed: Oct. 21, 1992

Related U.S. Application Data

[63] Continuation of Ser. No. 680,581, Apr. 4, 1991, abandoned.

[30] Foreign Application Priority Data

Apr. 4, 1990 [AT] Austria ..... A806/90

[51] Int. Cl.[5] ..... A63C 5/04

[52] U.S. Cl. ..... 280/607; 280/609; 280/610

[58] Field of Search ..... 280/609, 608, 610, 602, 280/601, 600, 607, 14.2; 441/68

[56] References Cited

U.S. PATENT DOCUMENTS

| | | | |
|---|---|---|---|
| 3,295,859 | 1/1967 | Perry | 280/609 |
| 3,378,275 | 4/1968 | Rockwood et al. | 280/609 |
| 3,907,315 | 9/1975 | Charneck | 280/609 |
| 3,947,049 | 3/1976 | Pedersen | 280/609 |
| 4,083,577 | 4/1978 | Ford | 280/609 |
| 4,085,947 | 4/1978 | Sarver | 280/609 |
| 4,141,570 | 4/1979 | Sudmeier | 280/607 |
| 4,343,485 | 8/1982 | Johnston et al. | 280/609 |
| 4,652,006 | 3/1987 | Desoutter | 280/610 |
| 4,995,631 | 4/1991 | Hunter | 280/14.2 |

FOREIGN PATENT DOCUMENTS

| | | | |
|---|---|---|---|
| 1132474 | 6/1962 | Fed. Rep. of Germany | 280/609 |
| 2627887 | 12/1977 | Fed. Rep. of Germany | 280/609 |
| 3800164 | 7/1989 | Fed. Rep. of Germany | 280/607 |
| 2559673 | 8/1985 | France | 280/609 |

*Primary Examiner*—David M. Mitchell
*Attorney, Agent, or Firm*—Collard & Roe

[57] ABSTRACT

An alpine ski with reinforcement layers, a top surface layer and a running surface layer. The ski has a width which is greater than 10 cm and is in the range of five percent and twenty percent of the length. The ski design makes skiing on soft snow, especially deep snow, possible for average skiers.

24 Claims, 3 Drawing Sheets

ALPINE SKI WITH A MINIMUM WIDTH AND SPECIFIC WIDTH/LENGTH RATIO

This is a continuation of copending application(s) Ser. No. 07/680,581 filed on Apr. 4, 1991 and now abandoned.

BACKGROUND OF THE INVENTION

1. Field of the Invention

The invention relates to an improved alpine ski. More particularly, it relates to such a ski with reinforcement layers, a top surface layer and a running surface layer, which ski is provided with a minimum width and a specific width-to-length ratio.

2. The Prior Art

Various types of alpine skis are already known. For example, the alpine skis used for downhill runs are manufactured in lengths between 160 cm and 230 cm for adults, adapted to the height and the weight as well as the skiing ability of the user. For touring or cross-country skiing, on the other hand, skis are used which generally correspond to alpine skis in terms of structure, but have a shorter length. Furthermore, the alpine skis known as spring snow gliders, which can be used in pairs, have an even shorter length, i.e., less than 1 m. Furthermore, it is also known to use one ski, such as mono-skis, snowboards, etc., instead of a pair of skis. When using one ski, which usually has a much greater width than an individual ski of a pair, the user either stands laterally to the direction of travel, or, as in the case of the mono-ski, with both feet above the mono-ski, via special support parts with projecting cantilevers.

Furthermore, for ski jumping, skis are known which have a significantly greater length and width in comparison with alpine skis. This is to increase the air resistance surface as much as possible to produce sufficient lift to increase the jump length.

All the skis mentioned above have more or less proven sufficient for the separate applications for which they are intended. With skis, particularly alpine skis, attempts have been made to find an intermediate design for the average user. Such a ski would have the size and camber designed in such a way that sufficient hold was guaranteed on hard and icy trails, while sufficient flexibility was provided for skiing on soft snow or deep snow.

SUMMARY OF THE INVENTION

It is therefore an object of the present invention to eliminate the aforementioned drawbacks of the prior art and to provide an alpine ski for use in pairs, which makes skiing on soft snow, especially deep snow, possible for average skiers.

This and other related objects are attained according to the invention by an alpine ski with at least one reinforcement layer, a top surface layer, and a running surface layer. The ski is provided with an attachment area for a binding. The width of the ski is at least 10 cm and is between five percent and twenty percent of the length.

It was surprisingly found that with a specific ratio between the length of the ski and its width, in combination with the greatest possible area of the running surface layer, a desireable alpine ski can be created. The ski according to the invention makes it possible for the user to stand facing the direction of travel, in other words with a direction of sight parallel to the longitudinal center axis of the skis. At the same time it produces sufficient lift in the soft snow or deep snow, which prevents momentary sinking of the ski and therefore overly great braking or catching of the ski during abrupt control movements. The ski makes it possible to learn a soft transition during the start and the end of the turn, so that training can be simplified in a surprising manner even for those skiers who intend to ski in deep snow with normal alpine skis later.

In addition, even with a pair of skis, it is possible to achieve significantly less stress on and damage to the environment, in an unforeseeable manner, especially in deep snow skiing. Therefore young plants, such as trees, bushes, etc., are protected from damage, particularly by the side edges of the skis, since the user no longer sinks as far below the snow surface. Another advantage as compared with a normal alpine ski lies in the fact that due to the large lift surface and the large running surface, maneuverability is possible in the area of the side edges even without steel edges. This makes it possible to eliminate another significant risk factor for damage to young plants caused during skiing in deep snow.

Advantageously, the ski has a length less than 200 cm. This facilitates short turns, especially when skiing on very narrow and steep gullies.

According to another embodiment, it is also possible that the area of the running surface layer be between 1500 $cm^2$ and 5000 $cm^2$, preferably 2200 $cm^2$. Surprisingly, this results in surface pressure reduced almost by half, even when using pairs of skis for skiing. This results in less compression of the snow cover and less stress on the soil and plants beneath it. It is furthermore possible for a larger number of persons to ski on deep snow slopes with approximately the same conditions, since overly great compression of the snow below the powder layer is avoided. As a result, approximately the same skiing conditions are maintained over an extended period of time.

Preferably, the binding axis runs at an angle to the longitudinal center axis of the ski where the distance between an inner side edge and the binding axis increases with a decreasing distance to the ski tip. In this manner, a position which corresponds to the natural position of the feet is possible without having to spread the legs apart too far, even with greater widths of the ski.

According to another preferred embodiment, the binding axis can be parallel to but offset from the longitudinal center axis. As a result, a standing width adapted to each user may be achieved.

According to a further advantageous embodiment, the top surface layer or running surface layer and additional reinforcement layers extend continuously to the side surfaces of the ski. This provides good flexibility and therefore advantageous adaptation to different surface level conditions of the trail are achieved.

A further desireable embodiment provides side faces which have strength or stress characteristics less than steel, for example, less than 300 $N/mm^2$. In this manner, curving of the ski lateral to the longitudinal direction due to overly great rigidity in the edge areas is eliminated, and damage to plants or trees which are present in the snow is reduced.

Most desireably, the travel characteristics can also be improved by shaping the ski so that it is structured symmetrically with respect to the binding axis. Bending of the ski can be aligned with reference to the mounting location of the binding. Therefore the travel behavior, i.e. the edge length for guiding the ski in a turn, is advantageously lengthened.

In another advantageous embodiment, the side surfaces intersect at the ski tip in the area of the binding axis. This improves the steering control of the ski and, at the same time, provides a better orientation, i.e., an orientation with which the user is familiar from normal skis.

In a further preferred embodiment, a portion of the side surfaces extends with respect to the longitudinal center axis. These configurations reduce asymmetrical edge stress. Also, a portion of the side surfaces may extend asymmetrically with respect to the binding axis.

In a particularly preferred embodiment, the side surfaces are concave in the area of the binding. This provides sufficient inherent damping in spite of the great width of the alpine ski. Straight side surfaces are suitably provided between the convex front and rear ends and the concave center area. This improves the guide length without requiring any greater effort for steering. The ski can also be provided with a camber in the area of the binding for improving the guidance of the ski.

According to another advantageous embodiment, the running surface is bent lateral to the longitudinal center axis and has a V-shaped cross-section. Outside digging of the ski is prevented, and also, guiding forces are directed more towards the inside edges of the skis.

Preferably, a part of the running surface extending in the direction of the outside side surface is angled upward in the area of the binding in the direction of the top surface layer. Travel behavior which corresponds to a normal ski can then be achieved on hard surfaces, i.e. on trails.

In another embodiment, the side edges of the side surfaces, i.e., the side faces, are rounded. This prevents digging or cutting of the ski.

Desirably, one or more guide grooves running parallel to the longitudinal center axis may be provided. This improves guidance stability on low new snow, i.e. on normal trails covered with soft snow.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
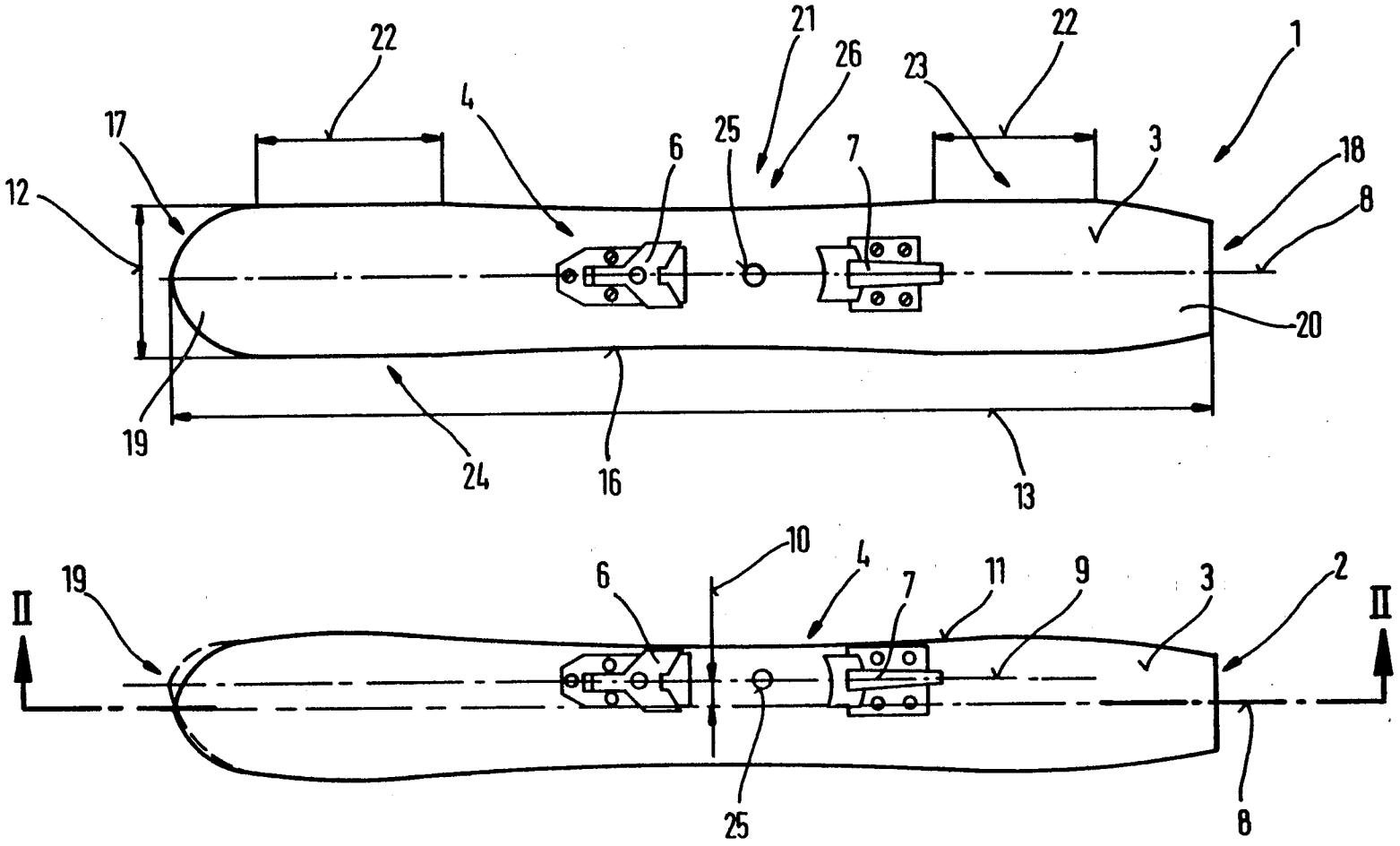
FIG. 1 is a schematically illustrated plan view of a pair of alpine skis embodying the present invention, with bindings attached in different positions.

Referring now in detail to the drawings and, in particular, FIG. 1, there is illustrated a pair of skis 1 and 2 for alpine skiing embodying the present invention. On a surface layer 3 of the skis 1 and 2, a binding 4 for attaching a ski boot (not shown for reasons of clarity) to the ski 1 or 2 is arranged, in each case.

Each of these bindings 4 consists of a toe clamp 6 and a heel clamp 7. Bindings 4 can be structured, arranged and attached according to any known method from the state of the art.

As is evident, binding 4 of ski 1 can be arranged centrally to a longitudinal center axis 8. Another variation of the arrangement of binding 4 is shown in connection with the ski 2. Here, binding 4 is arranged along a binding axis 9, which is arranged at a lateral distance 10 next to the longitudinal center axis 8, but running parallel to it, closer to an inside side edge 11.

This arrangement of binding 4 is particularly recommended if the skis 1 and 2 are structured with a width that comes close to the upper limit possible for this ski, since otherwise, the user of such a pair of skis 1 and 2 would have to spread his legs even for normal straightforward travel.

Figure 2:
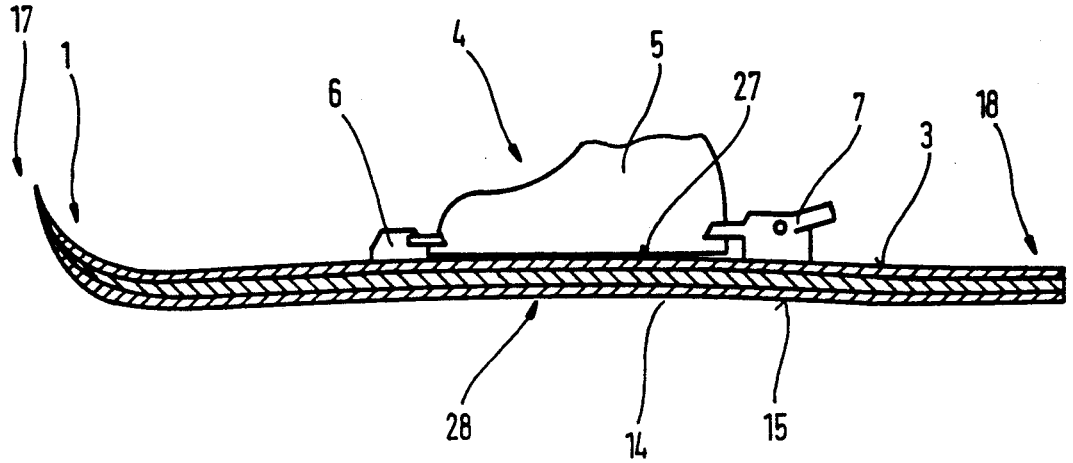
FIG. 2 is a lateral cross-sectional view of one of the skis taken along the lines II—II in FIG. 1.

The skis 1 and 2 according to the invention differ from the skis previously known by the fact that a width 12 amounts to between five percent (5%) and twenty percent (20%) of the length 13. Also, the width 12 is greater than 10 cm and a running surface 14 of a running surface layer 15 (see FIG. 2) is between 1500 $cm^2$ and 5000 $cm^2$, for example 2200 $cm^2$, 3600 $cm^2$ or 4000 $cm^2$.

This structure of skis 1 and 2 creates a large lift surface, which produces sufficient lift even with very soft, powder-type snow, particularly very dry snow. This type of snow predominantly occurs in America, Canada and the USSR, for example. Even when skiing very fast, correspondingly great lift is produced. This prevents overly deep sinking into the snow and therefore facilitates control of the skis. In addition, in a surprising and unforeseeable manner, this greater surface serves to dampen even abrupt changes in stress. It does not result in significant sinking of the ski under stress into the snow, which prevents uncontrolled locking or catching of the ski.

This now makes it possible to use such skis both for very experienced deep snow skiers as well as for beginners. The skis will allow experienced skiers to ski along such slopes at greater speeds. Beginners can learn the control phases in deep snow, without the frequent falls which are otherwise unavoidable.

The skis can advantageously be provided with a shaping 16. The side surfaces 23, 24 of the skis 1, 2 can be arranged to run straight over a longitudinal distance 22, between convex end areas 17, 18 in the area of a ski tip 19 and a ski end 20, and a concave center area 21.

With the degree of shaping, the travel behavior of the skis 1 and 2 can be additionally adapted to various uses. It is possible to decrease the longitudinal distances 22 or to provide smaller radii in the concave center area 21.

Shaping 16 can be especially directed towards a mounting location 25, which preferably is located in the longitudinal center of the ski 1 or 2. Mounting location 25 defines the attachment area 26 for binding 4. Usually, binding 4 is mounted centrally in the direction of the longitudinal center axis 8, i.e. usually the distance between the mounting location 25 and the front or toe clamp 6 and heel clamp 7 is equal.

By changing this distance, however, the ski may be adapted to individual needs in order to further support the lift effect, for example, by mounting the coupling device further back on the ski.

The structure of skis 1, 2 can follow any desired design principles for alpine skis or jumping skis or others known from the state of the art. As seen best in FIG. 2, the ski can be formed from several reinforcement layers 27 arranged between the running surface layer 15 and the top surface layer 3. Reinforcement layers 27 can consist of, for example, aluminum, fiberglass-reinforced plastic, metal, rubber, or similar materials. Predominantly, fiber-reinforced plastics with glass fibers, metal fibers, graphite fibers, ceramic fibers or the like are used for this. Of course, similar to alpine skis predominantly used for downhill runs, it is also possible to arrange corresponding cores in the interior of skis 1 and 2. Also, insertion parts can be provided to allow sufficiently stable attachment of binding 4, i.e. the front or toe clamp 6 and the heel clamp 7.

By structuring these reinforcement inserts and suitably shaping the individual layers during pressing, or even by a selection of the thicknesses of these reinforcement inserts or layers, a camber 28 can also be produced. Camber 28 can be located between the ski tip 19 and the ski end 20. Camber 28 pre-stresses the ski contrary to the main stress direction. In this way, similar advantages can be achieved for the invention as those already known from skis.

As shown in FIG. 1, ski 2 has a ski tip 19 that can be centered either relative to the longitudinal center axis 8 or to binding axis 9—as shown with a broken line. Of course it is also possible to give ski tip 19 any other desired shape, for example a semi-circular rounded shape, an elliptical or parabolic shape, or a progression at a slant to longitudinal center axis 8.

Figure 3:
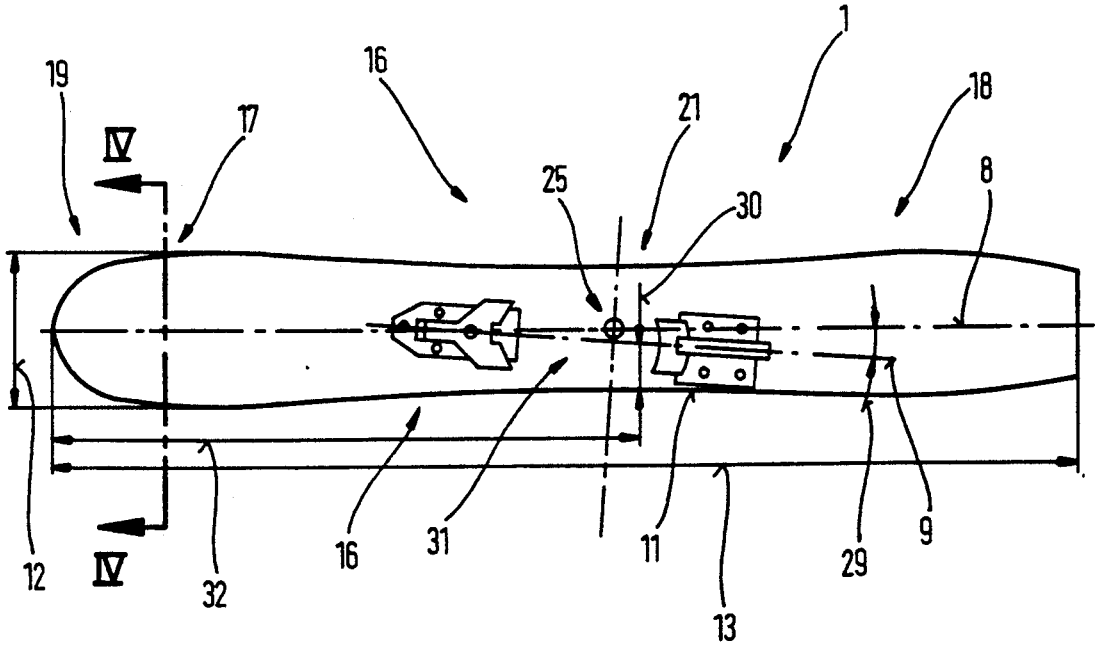
FIG. 3 is a schematically illustrated plan view of another embodiment of the invention, showing the ski with a binding axis running at an angle to the longitudinal center axis and with asymmetrical detailing.
Figure 4:
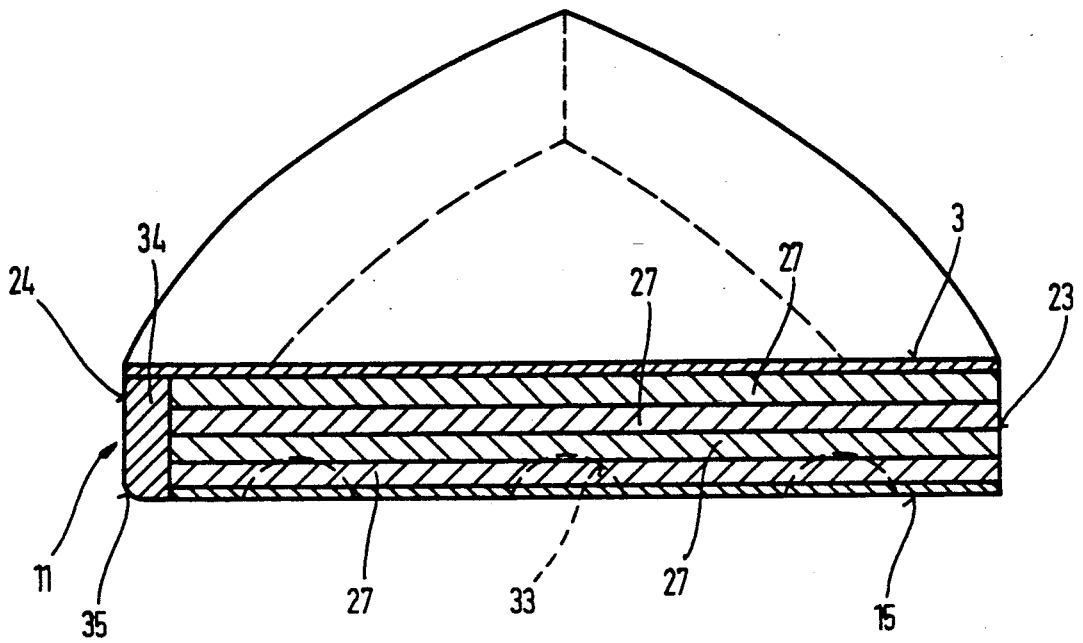
FIG. 4 is an enlarged front cross-sectional view taken along the lines IV—IV in FIG. 3.

In FIGS. 3 and 4, another preferred embodiment of ski 1 is shown, in which binding axis 9 runs at a slant to longitudinal center axis 8 of the ski. In addition, binding axis 9 is offset laterally in the direction of the inside side edge 11, relative to mounting location 25. The offset of binding axis 9 relative to the mounting location 25 can be adapted to the step width of each skier. In order to achieve unchanged travel behavior of the ski, if possible, when the binding axis is placed at a slant relative to the longitudinal center axis, shaping 16 can be asymmetrical relative to longitudinal center axis 8. Preferably, shaping 16 is then made relative to binding axis 9, so that when stress is placed on the ski in a turn, conditions are approximately the same in both directions. An angle 29 between longitudinal center axis 8 and binding axis 9 can be pre-selected by the manufacturer, or freely determined by the user. The same also holds true for a distance 30 between the inside side edge 11 and the mounting location 31 on the binding axis 9. In this embodiment, distance 30 increases as ski tip 19 is approached. In this case again, the front and rear end areas 17 and 18 of the ski 1 have a convex shape, and the shaping has a concave center area 21.

With the ski shown here, the width 12 is again approximately five percent to twenty percent of the length 13 of the ski. In the same way, the area of the running surface layer 15 is between 1500 $cm^2$ and 5000 $cm^2$, for example 2200 $cm^2$ 3600 $cm^2$ or 4000 $cm^2$.

This corresponds, for example, to a ski with a length 13 of approximately 170 cm and a width of approximately 13 cm. It is, of course, also possible to manufacture skis with a length of 180 cm at a width of 20 cm. In the same way, however, the ski can have a width up to 25 cm at a length of 160 cm.

The deciding factor is that a sufficiently large running surface is created, which allows correspondingly great lift of the skis 1, 2 in soft loose snow, and on the other hand distributes abrupt load changes over a larger area, so that rapid sinking of the ski is prevented. The damping of the stress changes achieved in this way prevents uncontrolled travel.

As shown in FIG. 4, several reinforcement inserts 27 can be arranged between the top surface layer 3 and the running surface layer 15. In the running surface layer 15, or the reinforcement layer adjacent to it, one or more guide grooves 33 can be provided, as is indicated with broken lines.

The top surface layer 3 and/or the running surface layer 15 and the reinforcement layers 27 can continue into the area of the side surfaces 23. In the area of the side surface 24, however, it is also shown as an alternative that the lateral end of the ski can be made with a side face 34. Side face 34 can optionally be provided with a rounded edge 35, especially at the inside side edge 11. However, the lateral end of the ski can also be produced with any possible combination of the different embodiments.

When using a side face 34, this is preferably made of a material which has strength or stress characteristics less than steel, in particular less than 300 $N/mm^2$, such as aluminum, for example. This ensures that even under great stress, the rounded edge 35 originally provided cannot be ground to a sharp edge, but remains blunt.

Figure 5:
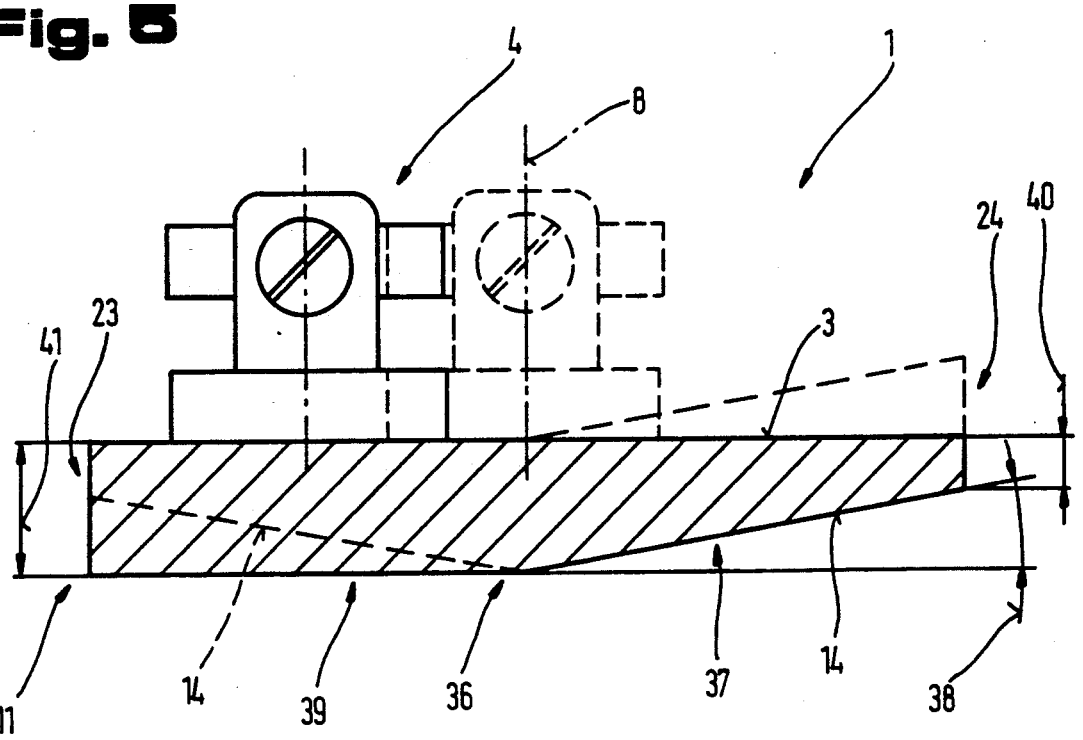
FIG. 5 is another enlarged, schematically illustrated front cross-sectional view in the area of the binding.

In FIG. 5, another structure of the ski 1 is shown, where the running surface has a bend 36 in a direction which runs perpendicular to the longitudinal center axis. Therefore, a ski portion 37 runs at an angle 38 to a portion 39 of the ski 1, on which the coupling device 4 is preferably arranged. This has the advantage that when traveling on hard surfaces or groomed trails, the contact surface of the ski 1 is approximately that of a normal ski. Therefore, control of the ski 1 on harder trails is also facilitated, without the user having the feeling that the contact surface of his feet is pivoted in the direction of the inside side edges 11. This would only be the case if, for example, the running surface 14 is bent symmetrical to the longitudinal center axis 8, as is indicated in part 39 of the running surface 14, for example, with broken lines.

Of course, with this structure it is also possible to mount the coupling device 4 centered relative to the longitudinal center axis 8. The ski can furthermore also have a different thickness 40, 41 in the area of the two side surfaces 23, 24. It is just as well possible, however, that the ski can have the same thickness in the area of the two side surfaces 23, 24. It is advantageous with the structure of the ski 1 with different thicknesses 40, 41 that a structure of the top surface layer 3 which is parallel to the standing surface in the area of the coupling device 4 is possible.

Finally, it should still be pointed out that for a simplified description of the invention, individual parts of the ski and coupling devices have only been indicated schematically and are shown disproportionately large or small in some cases.

Furthermore, individual embodiments in themselves, or even individual parts of the embodiments, such as the structure of the shaping, the arrangement of the coupling device, the structure of the ski tip and the progression of the running surface 14, i.e. the arrangement of the bend 36, can form the object of independent inventive solutions.

Thus, while only several embodiments of the present invention have been shown and described, it is to be understood that many changes and modifications may be made thereunto without departing from the spirit and scope of the invention as defined in the appended claims.

What is claimed is:

1. A pair of skis for downhill snow skiing, each of said pair of skis comprising:

a longitudinally extending body having an attachment area for a single binding, with a binding axis running lengthwise through said attachment area, said body having a top surface layer, a running surface layer having an area in the range of 3600 $cm^2$ to 5,000 $cm^2$, and at least one reinforcement layer sandwiched between said surface layers, and said body having a varying width along its length, the minimum width is 10 cm and the maximum width is in the range of eleven percent to twenty percent of its length, and a length greater than 160 cm.

2. The ski according to claim 1, wherein said body has a length of less than 200 cm.

3. The ski according to claim 1, wherein the width is approximately 15% of the length.

4. The ski according to claim 1, wherein said running surface layer has an area of 4,000 $cm^2$.

5. The ski according to claim 1, wherein said binding axis extends at an angle with respect to the longitudinal center axis of the ski body.

6. The ski according to claim 5, wherein the distance between the binding axis and an inner side edge of the ski body increases toward a front end of the ski body.

7. The ski according to claim 1, wherein said binding axis is offset from, and parallel to, the longitudinal center axis.

8. The ski according to claim 7, wherein the binding axis is located between the longitudinal center axis and an inner side edge.

9. The ski according to claim 1, wherein said top surface, running surface and additional reinforcement layers extend continuously to a side surface of the ski body.

10. The ski according to claim 1, wherein said ski body has side faces made of side walls having stress characteristics less than 300 $N/mm^2$.

11. The ski according to claim 10, wherein a portion of the ski body is shaped symmetrically with respect to said binding axis.

12. The ski according to claim 10, wherein a portion of said side faces extends asymmetrically with respect to the longitudinal center axis of the ski body.

13. The ski according to claim 10, wherein said side faces are concave in the region of the attachment area.

14. The ski according to claim 13, wherein said side faces are convex in the regions of the front and rear ends of the ski.

15. The ski according to claim 14, wherein said side faces run in a straight line between the concave attachment area region and the convex front and rear end regions.

16. The ski according to claim 1, wherein the ski has a camber in the region of the attachment area.

17. The ski according to claim 1, wherein said running surface is angled lateral to the longitudinal center axis and has a V-shaped cross-section.

18. The ski according to claim 17, additionally comprising side faces wherein a portion of said body extending in the direction of a side face is angled upward in the region of the attachment area.

19. The ski according to claim 10, wherein said side faces have rounded edges.

20. The ski according to claim 1, wherein said running surface layer defines at least one guide groove running parallel to the longitudinal center axis of the ski body.

21. The ski according to claim 1, additionally comprising a binding with a toe clamp and a heel clamp mounted in said attachment area.

22. The ski according to claim 1, wherein the length is 170 cm.

23. The ski according to claim 1, wherein the length is 180 cm.

24. A pair of skis for downhill snow skiing, each of said pair of skis comprising:

a longitudinal extending body having attachment area for a binding, with a binding axis running lengthwise through said attachment area, said body having a top surface layer, a running surface layer having an area in the range of 3600 $cm^2$ to 5000 $cm^2$, and at least one reinforcement layer sandwiched between said surface layers, and said body having a varying width along its length, the minimum width is between 10 cm and 13 cm and the maximum width is in the range of 11 percent to 20 percent of its length, and the length greater than 160 cm.

* * * * *